US006579069B2

(12) United States Patent
Tsegelsky

(10) Patent No.: US 6,579,069 B2
(45) Date of Patent: Jun. 17, 2003

(54) METHOD OF COMPRESSING GASEOUS HYDROCARBON-CONTAINING MEDIUM

(76) Inventor: Valery Grigorievich Tsegelsky, ulitsa Zelenodolskaya, 11, kv. 93, Moscow 109377 (RU)

( * ) Notice: Subject to any disclaimer, the term of this patent is extended or adjusted under 35 U.S.C. 154(b) by 0 days.

(21) Appl. No.: 10/012,951

(22) Filed: Dec. 10, 2001

(65) Prior Publication Data

US 2002/0048518 A1 Apr. 25, 2002

Related U.S. Application Data

(63) Continuation of application No. PCT/RU00/00168, filed on May 6, 2000.

(30) Foreign Application Priority Data

Jun. 16, 1999 (RU) ..... 99112938

(51) Int. Cl.[7] ..... F04B 1/00

(52) U.S. Cl. ..... 417/53; 417/54; 417/55; 208/58; 208/100; 208/213; 208/59

(58) Field of Search ..... 417/77, 53, 54, 417/55, 313; 208/7, 48 R, 49, 54, 58, 61, 67, 68, 80, 100

(56) References Cited

U.S. PATENT DOCUMENTS

| | | | | | |
|---|---|---|---|---|---|
| 4,756,821 | A | * | 7/1988 | Giuliani et al. | 208/102 |
| 4,857,168 | A | * | 8/1989 | Kubo et al. | 208/58 |
| 5,186,815 | A | * | 2/1993 | Lenglet | 208/48 R |
| 6,096,191 | A | * | 8/2000 | Kalnes | 208/105 |
| 6,171,473 | B1 | * | 1/2001 | Fornoff | 208/106 |
| 6,294,080 | B1 | * | 9/2001 | Thakkar et al. | 208/100 |
| 6,296,758 | B1 | * | 10/2001 | Kalnes et al. | 208/89 |
| 6,352,413 | B1 | * | 3/2002 | Popov | 417/77 |
| 6,428,686 | B1 | * | 8/2002 | Ackerson et al. | 208/213 |
| 6,451,197 | B1 | * | 9/2002 | Kalnes | 208/58 |
| 2002/0008051 | A1 | * | 1/2002 | Ishida et al. | 208/59 |

FOREIGN PATENT DOCUMENTS

| | | |
|---|---|---|
| RU | 2054583 | 2/1996 |
| RU | 2112156 | 5/1998 |
| SU | 968347 | 10/1982 |
| SU | 1201557 | 12/1984 |

OTHER PUBLICATIONS

International Search Report for PCT/RU00/00168.
Conclusion of Examination for PCT/RU00/00168.

* cited by examiner

*Primary Examiner*—Charles G. Freay
*Assistant Examiner*—Emmanuel Sayoc
(74) *Attorney, Agent, or Firm*—Fitch, Even, Tabin & Flannery

(57) ABSTRACT

The invention relates to the field of petrochemistry, in particular to a method of compressing a gaseous hydrocarbon-containing medium, for example, different hydrocarbon gases including flares produced in the oil refining and petrochemical industries. A distillate of a rectifying column of an atmosphere-vacuum oil refining unit is fed as the fresh liquid working medium into a circulation loop of a liquid hydrocarbon-containing medium, which contains a liquid-gas jet device, a separator and a pump. The liquid hydrocarbon-containing medium is removed from the circulation loop to a cracking and rectifying unit in which the liquid hydrocarbon-containing medium is subjected to cracking with subsequent rectification in the rectifying column of that unit. In another variant, a distillate from the rectifying column of the cracking and rectifying unit is fed into the circulation loop of liquid hydrocarbon-containing medium, and residue of hydrocarbon-containing medium is removed from the circulation loop back into the rectifying column.

As a result, the effectiveness of the method of compressing gaseous hydrocarbon-containing gases is enhanced while drying the compressible gas of heavier hydrocarbons and reducing the loss of hydrocarbon-containing products, which finally brings about enhancement of the ecological safety of the instant method.

4 Claims, 1 Drawing Sheet

METHOD OF COMPRESSING GASEOUS HYDROCARBON-CONTAINING MEDIUM

This is a continuation, of prior application number PCT/RU00/00168, filed May 6, 2000 and designating the U.S.A., which is hereby incorporated herein by reference in its entirety.

FIELD OF THE INVENTION

The invention relates to a method of compressing a gaseous hydrogen-comprising medium, for example, different hydrocarbon gases obtained mainly in the oil refining and petrochemical industries, for example, low-potential gas flares, with the simultaneous separation of heavy hydrocarbons from the gaseous hydrocarbon-containing mediums.

BACKGROUND ART

A method of compressing a hydrocarbon-containing medium is known, the method including feeding unpurified hydrocarbon gas to a liquid-gas jet device, feeding a liquid medium—a sorbent of impurities of the hydrocarbon gas, by a pump under pressure to the nozzle of the liquid-gas device, forming in the jet device while mixing the gaseous and liquid hydrocarbon-containing mediums a gas-liquid mixture with absorption of the impurities of the hydrocarbon gas and compression of the gaseous medium, feeding the gas-liquid mixture from the liquid-gas jet device to a separator, separating in the latter the gas-liquid mixture into compressed gas and a liquid sorbent and removing the compressed gas from the separator to a consumer and the liquid-sorbent to the pump input, with the formation of a loop of circulation of the liquid medium, wherein a portion of the liquid-sorbent after separation is removed for regeneration, after which the liquid-sorbent is returned to the circulation loop (see, for example, patent RF 2054583, IPC 6 F 04 F 5/54, 1996).

A drawback of the known method is that it provides for absorption of only harmful impurities which are in the gaseous hydrocarbon-containing medium, for example, hydrogen sulfide, which narrows the field of use of this method of compressing a gaseous hydrocarbon-containing medium.

The method most similar to the invention in respect to technical essence and achieved result is the method of compressing a gaseous hydrocarbon-containing medium, comprising feeding a gaseous hydrocarbon-containing medium to a liquid-gas jet device, feeding a liquid hydrocarbon-containing medium by a pump under pressure to a nozzle of the liquid-gas jet device, forming in the jet device while mixing the gaseous and liquid hydrocarbon-containing mediums a gas-liquid mixture with a pressure exceeding the pressure of the gaseous hydrocarbon-containing medium, and absorbing a portion of the gaseous hydrocarbon-containing medium by means of a liquid medium, feeding the gas-liquid mixture from the liquid-gas jet device to a separator, separating in the separator the gas-liquid mixture into compressed gas and a liquid hydrocarbon-containing medium and removing the compressed gas from the separator to a consumer and the liquid hydrocarbon-containing medium to the pump input, with the formation of a loop of circulation of the liquid hydrocarbon-containing medium, the loop including a pump—a liquid-gas jet device—a separator—a pump, removing a portion of the liquid hydrocarbon-containing medium from the circulation loop and supplying fresh liquid working medium to the circulation look (see, SU, Inventor's Certificate 968347, IPC 6 E 21 B 43/00, published 1980).

This method provides for use as the liquid medium fed to the nozzle of the jet device a liquid capable of absorbing a portion of the gases, mainly steam, from the gaseous medium fed to the jet device and, as a result thereof, the pumped gas is dried prior to feeding it to the consumer. In the process of carrying out this method, the possibility is provided for gathering easily condensed components of the gaseous medium in the separator. However this method of compressing and supplying gaseous mediums under pressure requires constant regeneration of the liquid medium—the sorbent, which is not affinitive in respect to the chemical composition of the medium being compressed—which requires the expenditure of energy to carry out this method. Furthermore, the method of compressing a gaseous hydrocarbon-containing medium and conveying it to the separator is carried out exclusively due to the use of mechanical energy of the liquid jet of the jet device and, accordingly, other possible variants of interaction of the liquid hydrocarbon-containing medium and the gaseous hydrocarbon-containing medium are not used, in particular absorption of the hydrocarbons contained in the gas, by means of the liquid medium. This increases the energetic expenditures on compressing and supplying to the consumer the gaseous hydrocarbon-containing medium and results in a reduction of the economic efficiency of this method of compressing and supplying the gaseous hydrocarbon-containing medium to the consumer under pressure. Furthermore, this method does not provide the possibility for separation of heavier hydrocarbons from the compressible hydrocarbon-containing medium by absorption, since diethyleneglycol, which does not provide an increase of the depth of processing the initial gas, is used as the sorbent.

DISCLOSURE OF THE INVENTION

The object of the instant invention is to enhance the effectiveness of the method of compressing a gaseous hydrocarbon-containing medium by reducing the energetic expenditures on compressing the gaseous medium and reducing loss of the hydrocarbon-containing products by absorbing heavy hydrocarbons with their subsequent isolation and supply to the consumer, which as a result brings about a substantial reduction of contamination of the environment and enhancement of the reliability of this method of compressing.

The stated object is achieved in that in a method of compressing a gaseous hydrocarbon-containing medium, comprising feeding a gaseous hydrocarbon-containing medium to a liquid-gas jet device, feeding a liquid hydrocarbon-containing medium by a pump under pressure to a nozzle of the liquid-gas jet device, forming in the jet device while mixing the gaseous and liquid hydrocarbon-containing mediums a gas-liquid mixture with a pressure exceeding the pressure of the gaseous hydrocarbon-containing medium, and absorbing a portion of the gaseous hydrocarbon-containing medium by means of a liquid medium, feeding the gas-liquid mixture from the liquid-gas jet device to a separator, separating in the separator the gas-liquid mixture into compressed gas and a liquid hydrocarbon-containing medium and removing the compressed gas from the separator to a consumer and the liquid hydrocarbon-containing medium to the pump input, with the formation of a loop of circulation of the liquid hydrocarbon-containing medium, the loop including a pump—a liquid-gas jet device—a separator—a pump, removing a portion of the liquid hydrocarbon-containing medium from the circulation loop and supplying fresh liquid working medium to the circulation loop, wherein a distillate of a rectifying column is fed as the fresh liquid working medium into the loop of circulation of the liquid hydrocarbon-containing medium, liquid hydrocarbon-containing medium is removed from the circulation loop into a cracking and rectification unit in which the liquid hydrocarbon-containing medium is subjected to cracking with subsequent rectification in the rectifying column of that unit.

Gas oil of the rectifying column may, for example, be used as the fresh liquid working medium.

Another variant of a method of compressing a gaseous hydrocarbon-containing medium comprises feeding a gaseous hydrocarbon-containing medium to a liquid-gas jet device, feeding a liquid hydrocarbon-containing medium by a pump under pressure to a nozzle of the liquid-gas jet device, forming in the jet device while mixing the gaseous and liquid hydrocarbon-containing mediums a gas-liquid mixture with a pressure exceeding the pressure of the gaseous hydrocarbon-containing medium, and absorbing a portion of the gaseous hydrocarbon-containing medium by means of a liquid medium, feeding the gas-liquid mixture from the liquid-gas jet device to a separator, separating in the separator the gas-liquid mixture into compressed gas and a liquid hydrocarbon-containing medium and removing the compressed gas from the separator to a consumer and the liquid hydrocarbon-containing medium to the pump input, with the formation of a loop of circulation of the liquid hydrocarbon-containing medium, the loop including a pump—a liquid-gas jet device—a separator—a pump, removing a portion of the liquid hydrocarbon-containing medium from the circulation loop and supplying fresh liquid working medium to the circulation loop, wherein the liquid hydrocarbon-containing medium is removed from the circulation loop into a rectifying column of a cracking and rectifying unit, hydrocarbon-containing gas, residue and one or more distillates are obtained at an output from that rectifying column, a portion of the distillate is directed from the rectifying column as fresh liquid working medium to the circulation loop of the liquid hydrocarbon-containing medium, and the hydrocarbon-containing gas, residue and unused portion of the distillate are sent to the consumer.

The diesel fraction of the rectifying column may be used as fresh liquid working medium.

Compression of the low-potential hydrocarbon-containing gases, primarily flare, makes it possible on the one hand to protect against contamination of the environment, and on the other hand to use these gases as fuel gas or as feedstock for further processing. In order to use these gases as fuel gas, it is necessary to separate from the compressible hydrocarbon-containing gases heavier, as compared with methane, fractions, such as, for example, propane-propylene, butane-butylene and other heavier hydrocarbons which are valuable feedstock for petroleum chemistry.

The use of mechanical compressors (piston, centrifugal, rotary and others) require compression of low-potential hydrocarbon-containing gases to sufficiently high pressures at which a condensate of heavy hydrocarbons will fall out of these gases during cooling.

The use of the unit in accordance with the invention with a liquid-gas jet device (ejector), into which a liquid hydrocarbon-containing medium is fed by means of a pump, substantially simplifies achievement of the stated object, reduces energy consumption and, with correct organization of the processing the liquid hydrocarbon-containing medium, provides for separation of the hydrocarbons contained in the compressible gas and dissolved in the liquid.

As the conducted studies showed, the process of compressing the gaseous hydrocarbon-containing medium in the liquid-gas jet device with the simultaneous absorption of a portion thereof by means of the liquid working medium supplied into the jet device, reduces energy consumption in the process of compressing the gaseous medium.

This is related to the fact that in the process of compression, a portion of the hydrocarbon-containing gases is dissolved in the liquid hydrocarbon-containing working medium, which reduces the amount of the gas being compressed and, accordingly, reduces energy consumption for compression. On the other hand, the use of different hydrocarbon-containing liquids, for example, gas oil, diesel fraction or one of the distillates of the rectifying column, as the liquid working medium of the jet device, provides for a change of the quantitative and qualitative composition of the hydrocarbons absorbed with the aid of the liquid from the compressible gas. This results in a change in the amount and composition of the compressed gas.

It is also possible to change the amount and qualitative composition of the compressed gas by changing the amount of fresh liquid working medium fed as additional stock into the circulation loop of the hydrogen-containing medium and interacting with the compressible gaseous hydrocarbon-containing medium in the liquid-gas jet device. As a result of such a method of compressing, hydrocarbons accumulate in the liquid hydrocarbon-containing medium, the hydrocarbons passing thereinto from the compressible gas in the process of absorption and condensation. This requires subsequent processing of the liquid hydrocarbon-containing medium in order to separate therefrom the hydrocarbons absorbed from the gas. The correct selection of the liquid working medium and subsequent processing thereof make the proposed method of compressing the gaseous hydrocarbon-containing medium simpler and more economical as compared with other existing methods.

The reduction of the power consumption of the unit with a liquid-gas jet device (ejector) as compared with mechanical compressors is due to the fact that in order to separate one and the same amount of, for example, a propane-propylene, butane-butylene fraction from the compressed gas, it is required in that unit to compress hydrocarbon-containing gas by means of the working liquid to less pressures than is required when a mechanical compressor is used.

Furthermore, in the case of compression of a hydrocarbon-containing medium with a mechanical compressor (centrifugal, piston), the formation of a condensate in the process of compressing is not permissible, since it will result in disturbance of the operation of the compressor. In view of this when a gaseous hydrocarbon-containing medium is compressed with a mechanical compressor, the temperature and pressure are maintained at such values that condensation of the hydrocarbons is not possible. Then conditions are created in specially designed equipment for condensation of heavy hydrocarbons and their separation from the compressed gas.

Thus, when a mechanical compressor is used, additional energetic and financial expenditures are required as compared with the method of compressing proposed in the application in which the process of compressing takes place simultaneously with absorption of a portion of the compressible hydrocarbon-containing gas by means of the hydrocarbon-containing working liquid and with condensation of the gas.

The gas-liquid mixture obtained in the liquid-gas jet device is fed into the separator, where compressed gas is separated from the liquid medium, the composition of the compressed gas differing from the composition of the gaseous hydrocarbon-containing medium fed for compression by a lesser content of the heavier gaseous hydrocarbons (propane, propylene, butane, butylene, pentane and others). Accumulation of these hydrocarbons in the liquid working medium prevents valuable products being carried away with compressed gas from the separator, wherein this method of accumulating is controllable. As a result of accumulation of the portion of the heavier hydrocarbons of the compressible gas in the liquid working medium, the moment may come when the jet device stops providing the required parameters or interruption of its operation will occur.

Achievement of a controllable method for accumulation of hydrocarbons in compressible gas in a liquid working medium and for separation of them therefrom is provided by means of feeding a portion of the compressible gas saturated with hydrocarbons in the liquid working medium into the cracking and rectifying unit or, depending on the conditions, right away for rectification with the simultaneous replacement of the portion of the liquid hydrocarbon-containing medium with fresh working liquid. Wherein, two problems are immediately solved—the output of the final product—propane-propylene, butane-butylene and heavier hydrocarbons contained in the initial compressible gas—is increased and a stable composition of the liquid hydrocarbon-containing medium fed to the nozzle of the liquid-gas jet device is maintained, which enhances the reliability of operation of the unit.

At the same time, there is a large amount of methane and ethane contained in the compressed gas as compared with the initial gas, which brings it closer in respect to composition to natural gas and ensures its use, for example, in boiler works.

The selection of a concrete method of compressing hydrocarbon-containing gaseous mediums from the variants disclosed in the application is determined by the necessary depth of processing the initial stock, the required degree of compression of the gaseous hydrocarbon-containing medium and the composition of the compressed gas, and also by which the distillates is used as the liquid hydrocarbon-containing medium to be fed into the nozzle of the jet device. So, the diesel fraction to a higher degree than gas-oil absorbs the hydrocarbons of groups $C_2$, $C_3$, $C_4$ and others. Gas oil however ensures achievement of a greater degree of compression of the gaseous hydrocarbon medium. Therefore, if it is necessary to separate more propane, propylene, butane, butylene and heavier components from the compressible gas, it is more preferable to use the diesel fraction as the fresh liquid working medium, and if it is necessary to obtain more compressed gas with a greater molecular weight, it is better to use gas oil. At the same time, the selection of the liquid working medium determines selection of the scheme in accordance with which the method being disclosed of compressing the gaseous hydrocarbon-containing medium with absorption of a portion of the gaseous medium is realized. If the diesel fraction is used as the fresh liquid working medium, than a scheme of unit operation is used whereby after the separator, the liquid hydrocarbon-containing medium is directed directly to the rectifying column of the cracking and rectifying unit, and then from that column the distillate—diesel fraction, is directed as the fresh liquid working medium to the circulation loop of the liquid hydrocarbon-containing medium. In the case, where gas oil, obtained, for example, in a unit for atmosphere-vacuum processing of oil, is used as the liquid working medium, the liquid hydrocarbon-containing medium is directed from the separator first to the cracker and then the cracking products are directed to the rectifying column of the cracking and rectifying unit. In a number of cases selection of the liquid working medium may depend on the concrete construction of the plant.

In any of the variants being considered, the cracking and rectifying unit is a necessary and very important element of the method of compressing gas being described, since due to it separation of the hydrocarbon gaseous components absorbed by means of the liquid working medium takes place, and this makes this method of compressing very effective and economical.

The combination of the processes of removing a portion of the liquid hydrocarbon-containing medium from the circulation loop and inputting a fresh liquid working medium into the circulation loop, use of the absorption processing together with compression of the gaseous hydrocarbon-containing medium, and also the correct selection of the fresh liquid working medium as additional stock for the circulation loop ensures a reduction of the energy necessary for compression, enhancement of the qualitative composition of the compressed gas and simultaneous output, in the form of a final product, of heavier hydrocarbons contained in the compressible gas.

Thus, fulfillment of the object of the invention—to enhance the efficiency of the method of compressing and feeding gaseous hydrocarbon-containing gases under pressure with a simultaneous increase of the depth of processing the initial stock—a compressible hydrocarbon-containing medium—is achieved, which finally results, in addition to enhancement of the efficiency, to enhancement of the ecological safety of this industry.

PREFERABLE METHOD OF CARRYING OUT THE INVENTION

Figure 1:
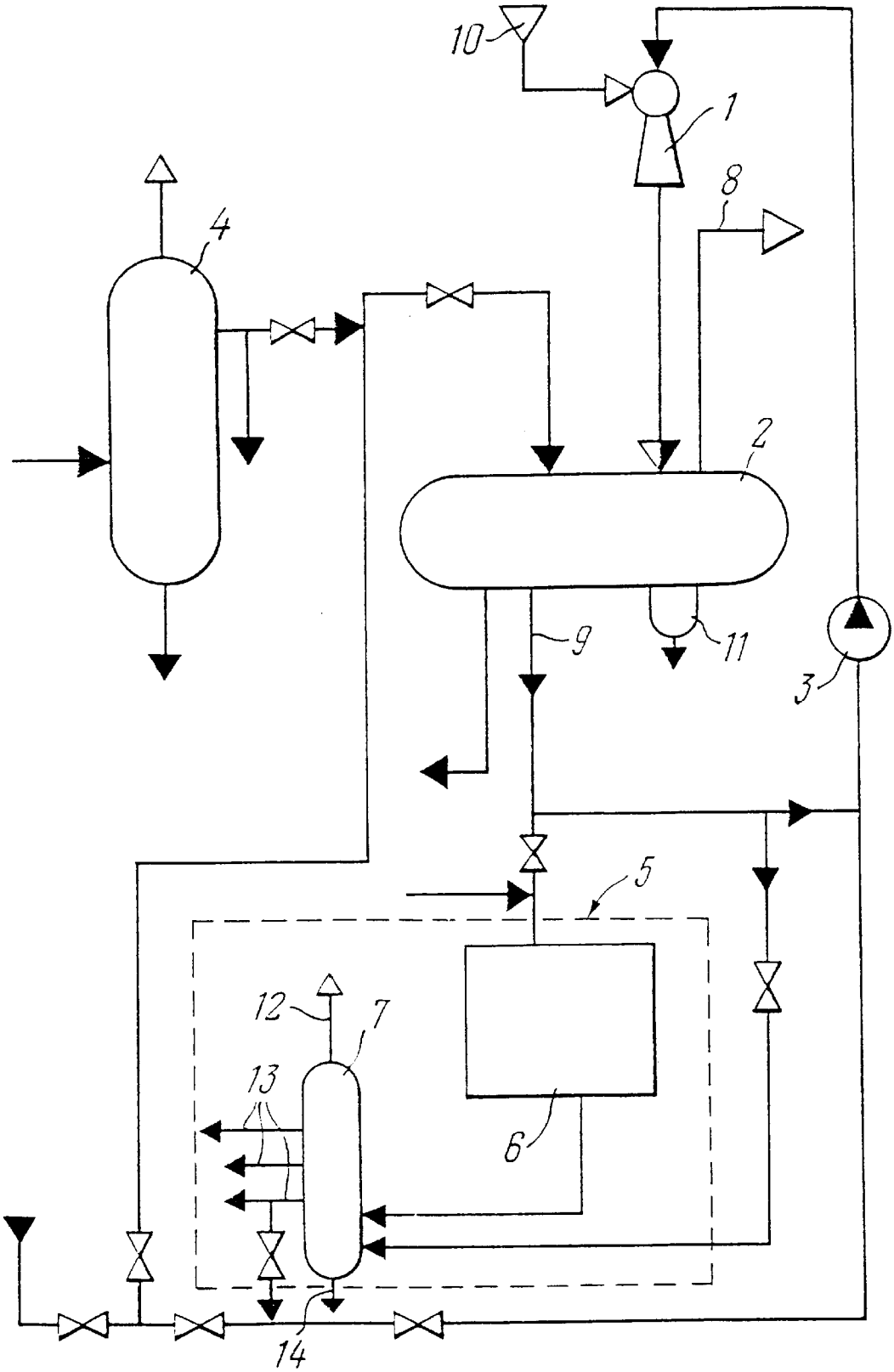
FIG. 1 shows a diagram of the unit in which the described method of compressing a gaseous hydrocarbon-containing medium is carried out.

The plant contains a liquid-gas jet device 1 (liquid-gas ejector), a separator 2, a pump 3, a rectifying column 4, for example, an atmosphere-vacuum oil processing unit and a cracking and rectifying unit 5, including a cracker 6 and a rectifying column 7, wherein an output of the pump 3 is connected to a nozzle of the liquid-gas jet device 1. A gas input of the jet device 1 is connected to a hydrocarbon-containing gas main 10, and an output for the liquid-gas mixture is connected to the separator 2. A compressed gas output 8 of the separator 2 in turn is connected to a consumer of that compressed gas, and an output 9 of a liquid hydrocarbon-containing medium is connected to a input of the pump 3 and to the cracking and rectifying unit 5, and more concretely, to the cracker 6 or to the rectifying column 7, the cracker 6 in turn is also connected to the rectifying column 7. Thus, a loop for circulation of the liquid hydrocarbon-containing medium is formed, the loop including the jet device 1—separator 2—pump 3—jet device 1. The rectifying column 4 and the rectifying column 7 of the cracking and rectifying unit 5 are connected via a distillate output or one of the distillate outputs to the circulation loop of the liquid hydrocarbon-containing medium, for example, to the separator 2 or to an input of the pump 3. The separator 2 may be made with a settling tank 11 for removal of a non-hydrocarbon-containing liquid medium, for example, water, which has accumulated in the separator 2. The loop for circulation of the liquid hydrocarbon-containing medium may be made with a cooling device, for example, with an air cooler (now shown in the drawing). The removal of hydrocarbon-containing gas from the upper part of the rectifying column 7 of the cracking and rectifying unit 5 is carried out along a main line 12, removal of the residue of the column 7 along main line 14 and the distillates along main lines 13.

The described method of compressing a gaseous hydrocarbon-containing medium is carried out in the following manner.

The liquid hydrocarbon-containing medium is fed under pressure by the pump 3 to the nozzle of the liquid-gas jet device 1. Leaving the nozzle, this medium provides for supplying a gaseous hydrocarbon-containing medium, at a positive pressure in respect to the environment, from the main 10 to the jet device 1. In the jet device 1, the liquid hydrocarbon-containing medium is mixed with the hydrocarbon-containing gaseous medium and compressed it. Simultaneously the liquid hydrocarbon-containing medium absorbs a portion of the gaseous medium. Partial condensation of the gaseous medium is also possible (depending on the composition of the gaseous medium) when it is compressed and a mixture of the condensate with the hydrocarbon-containing liquid medium may occur. The gas-liquid mixture obtained in the jet device 1 is fed into the separator 2 in which the gas-liquid mixture is divided into compressed gas and liquid hydrocarbon-containing medium. The compressed gas is removed via the output 8 of the separator 2 to a consumer of the compressed gas, while the liquid hydrocarbon-containing medium is fed again to the input of the pump 3. A portion of the liquid hydrocarbon-containing medium from the separator 2 is removed (depending on the variant of embodiment) to the cracker 6 or to the rectifying column 7 of the cracking and rectifying unit 5.

In the first variant of implementing the method, the liquid hydrocarbon-containing medium is fed to the cracker 6 where it is converted into a mixture of lighter hydrocarbons as a result of cleaving hydrocarbons with long chains. The mixture of hydrocarbons from the cracker 6 is fed to the rectifying column 7 where it is divided into hydrocarbon-containing gas, distillates and residue, which are directed to the consumer in accordance with the purpose. Simultaneously, the distillate or one of the distillates, for example, gas oil, is fed to the loop for circulation of the liquid hydrocarbon-containing medium from the rectifying column 4, for example, from the atmosphere-vacuum oil processing unit and or the rectifying column 7, in order to compensate the amount of liquid hydrocarbon-containing medium removed from the circulation loop and simultaneously to restore the composition of the liquid hydrocarbon-containing medium before it is fed to the nozzle of the jet device 1.

In the second variant of realization of the method, a portion of the liquid hydrocarbon-containing medium is fed from the separator directly to the rectifying column 7 of the cracking and rectifying unit 5, where the lighter components are separated therefrom as a result of distillation. As a result hydrocarbon-containing gas, removed along the main line 12, distillates and residue are obtained at the output from the rectifying column 7. Then a portion of one of the distillates of the rectifying column 7, for example, the diesel fraction being removed along the main line 13, is directed to the loop for circulation of the liquid hydrocarbon-containing medium in order to compensate for the removed amount of the liquid medium and to restore the composition of the liquid hydrocarbon-containing medium before feeding it to the nozzle of the jet device 1.

The amount of the liquid medium removed from the separator 2 into the cracking and rectifying unit 5 is greater than the amount of fresh liquid working medium supplied thereto from the rectifying column 4 or 7 by the amount of hydrocarbon gas absorbed by means of the liquid medium. Division into fractions of hydrocarbon gas, absorbed by means of the liquid hydrocarbon-containing medium is carried out in the rectifying column 7 and gas-fractionating unit (not shown in FIG. 1) connected as a rule thereto via the main line 12.

INDUSTRIAL APPLICABILITY

The present invention may be used in the chemical and petrochemical industry for compressing and feeding low-pressure hydrocarbon-containing gases, for example, flare gases, to a consumer for further use.

What is claimed is:

1. A method of compressing a gaseous hydrocarbon-containing medium comprising:

feeding a gaseous hydrocarbon-containing medium to a liquid-gas jet device;

feeding a liquid hydrocarbon-containing medium by a pump under pressure to a nozzle of the liquid-gas jet device;

forming a gas-liquid mixture in the liquid-gas jet device while mixing the gaseous hydrocarbon-containing medium and liquid hydrocarbon-containing medium, and absorbing a portion of the gaseous hydrocarbon-containing medium in the liquid hydrocarbon-containing medium, the gas-liquid mixture having a pressure exceeding the pressure of the gaseous hydrocarbon-containing medium;

feeding the gas-liquid mixture from the liquid-gas jet device to a separator;

separating the gas-liquid mixture into compressed gas and a liquid hydrocarbon-containing medium;

removing the compressed gas and liquid hydrocarbon-containing medium from the separator;

removing a portion of the liquid hydrocarbon-containing medium into a cracking and rectification unit in which the removed portion of the liquid hydrocarbon-containing medium is subjected to cracking with subsequent rectification in a rectifying column to provide a fresh liquid working medium; and combining the fresh liquid working medium with the liquid-hydrocarbon-containing medium removed from the separator.

2. The method according to claim 1, wherein gas oil of the rectifying column is used as the fresh liquid working medium.

3. A method of compressing a gaseous hydrocarbon-containing medium comprising:

feeding a gaseous hydrocarbon-containing medium to a liquid-gas jet device;

feeding a liquid hydrocarbon-containing medium by a pump under pressure to a nozzle of the liquid-gas jet device;

forming a gas-liquid mixture in the liquid-gas jet device while mixing the gaseous hydrocarbon-containing medium and liquid hydrocarbon-containing medium, and absorbing a portion of the gaseous hydrocarbon-containing medium in the liquid hydrocarbon-containing medium, the gas-liquid mixture having a pressure exceeding the pressure of the gaseous hydrocarbon-containing medium;

feeding the gas-liquid mixture from the liquid-gas jet device to a separator;

separating the gas-liquid mixture into compressed gas and a liquid hydrocarbon-containing medium;

removing the compressed gas and liquid hydrocarbon-containing medium from the separator;

removing a portion of the liquid hydrocarbon-containing medium into a rectifying column of a cracking and rectifying unit to provide one or more distillates as a fresh liquid working medium; and combining the fresh liquid working medium with the liquid hydrocarbon-containing medium removed from the separator.

4. The method according to claim 3, wherein a diesel fraction of the rectifying column is used as the fresh working medium.

* * * * *